US010870277B2

(12) United States Patent
Hirota

(10) Patent No.: US 10,870,277 B2
(45) Date of Patent: Dec. 22, 2020

(54) LIQUID DISCHARGE HEAD AND METHOD OF PRODUCING LIQUID DISCHARGE HEAD

(71) Applicant: Brother Kogyo Kabushiki Kaisha, Nagoya (JP)

(72) Inventor: Atsushi Hirota, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/174,355

(22) Filed: Oct. 30, 2018

(65) Prior Publication Data

US 2019/0270307 A1 Sep. 5, 2019

(30) Foreign Application Priority Data

Mar. 5, 2018 (JP) ..... 2018-038939

(51) Int. Cl.
*B41J 2/14* (2006.01)
*B41J 2/16* (2006.01)

(52) U.S. Cl.
CPC ..... *B41J 2/1433* (2013.01); *B41J 2/14233* (2013.01); *B41J 2/161* (2013.01); *B41J 2/162* (2013.01); *B41J 2/1623* (2013.01); *B41J 2/1626* (2013.01); *B41J 2/1632* (2013.01); *B41J 2/1634* (2013.01); *B41J 2002/14241* (2013.01); *B41J 2002/14419* (2013.01); *B41J 2002/14491* (2013.01); *B41J 2202/11* (2013.01)

(58) Field of Classification Search
None
See application file for complete search history.

(56) References Cited

U.S. PATENT DOCUMENTS 8,070,268 B2 12/2011 Okazawa et al.
2008/0204512 A1 8/2008 Okazawa et al.
2010/0141712 A1* 6/2010 Kim ..... B41J 2/161 347/68
2011/0193916 A1* 8/2011 Hirai ..... H01L 41/0475 347/71

FOREIGN PATENT DOCUMENTS

JP 2005-153369 A 6/2005
JP 2006-272913 A 10/2006
(Continued)

OTHER PUBLICATIONS

Apr. 9, 2019—(EP) Extended Search Report—App 18201027.2.

*Primary Examiner* — Erica S Lin
(74) *Attorney, Agent, or Firm* — Banner & Witcoff, Ltd.

(57) ABSTRACT

There is provided a liquid discharge head including a substrate having a pressure chamber, an actuator, and a channel member. The actuator has a first film arranged on the substrate and a second film arranged on a surface of the first film. The substrate and the channel member are attached to each other with an adhesive. A first through hole is formed in a part of the first film, and a second through hole is formed in a part of the second film. An edge of the first through hole is positioned further inward of the second through hole than an edge of the second through hole. The adhesive is applied to a part of the surface of the first film overlapping with the second through hole, so as to cover a boundary part between the first and second films.

16 Claims, 12 Drawing Sheets

(56) References Cited

FOREIGN PATENT DOCUMENTS

| | | | |
|---|---|---|---|
| JP | 2007-165651 | A | 6/2007 |
| JP | 2008-155430 | A | 7/2008 |
| JP | 2008-207443 | A | 9/2008 |
| JP | 2009-214522 | A | 9/2009 |
| JP | 2017-052142 | A | 3/2017 |

* cited by examiner

LIQUID DISCHARGE HEAD AND METHOD OF PRODUCING LIQUID DISCHARGE HEAD

CROSS REFERENCE TO RELATED APPLICATION

The present application claims priority from Japanese Patent Application No. 2018-038939 filed on Mar. 5, 2018, the disclosures of which is incorporated herein by reference in its entirety.

BACKGROUND

Field of the Invention

The present disclosure relates to a liquid discharge head configured to discharge liquid from nozzles and a method of producing a liquid discharge head.

Description of the Related Art

There is known an ink jet recording head in which a piezoelectric element substrate is formed on the upper surface of a silicon substrate formed with pressure chambers. In the piezoelectric element substrate, piezoelectric elements are coated and protected with SiOx film, and a partition-wall resin layer is stacked on the SiOx film. The partition-wall resin layer is formed therein with an ink supply port in communication with the pressure chambers. Then, according to the ink jet recording head, by supplying ink to the pressure chambers through ink supply pass-through channels formed in the partition-wall resin layer, it is possible to prevent the ink from leaking out into the area of the piezoelectric elements.

Further, there is known that when the ink jet recording head as described above is manufactured, on the silicon substrate, a plurality of films are formed in sequence to constitute the piezoelectric element substrate. On this occasion, the plurality of films are formed to provide space for arranging the partition-wall resin layer. Thereafter, the partition-wall resin layer is patterned. On this occasion, the supply port is formed along.

SUMMARY

Here, in the ink jet recording head as described above, in order to prevent the ink from leaking out to the piezoelectric element area, a dedicated partition-wall resin layer is needed. Further, when producing ink jet recording heads having a partition-wall resin layer, at the time of forming the films to constitute the piezoelectric element substrate, after the films are formed to spare space for arranging the partition-wall resin layer, it is necessary to pattern the partition-wall resin layer. Therefore, the ink jet recording heads are subject to a complicated manufacturing process.

An object of the present disclosure is to provide a liquid discharge head which can be simply manufactured or produced and a method of producing the liquid discharge head, without needing any dedicated member for preventing a liquid from penetrating into driving elements.

According to an aspect of the present disclosure, there is provided a liquid discharge head including: a substrate including a pressure chamber; an actuator including a driving element configured to apply pressure to liquid in the pressure chamber; and a channel member. The channel member includes a supply channel configured to supply the liquid to the pressure chamber. The actuator includes: a first film arranged on the substrate to cover the pressure chamber; and a second film arranged on an opposite surface of the first film, the opposite surface being opposite to the substrate. The substrate and the channel member are attached to each other with an adhesive in a state that the first film and the second film are sandwiched between the substrate and the channel member. A first through hole is located in a part of the first film at which the pressure chamber and the supply channel are overlapped in a stacking direction of the first film and the second film. A second through hole is located in a part of the second film at which the the first through hole is overlapped in the stacking direction. An edge of the first through hole is positioned further inward of the second through hole than an edge of the second through hole. The adhesive is applied to a part of the opposite surface of the first film at which the second through hole is overlapped in the stacking direction, so as to cover a boundary part between the first film and the second film.

DESCRIPTION OF THE EMBODIMENT

An embodiment of the present disclosure will be explained below.

<Schematic Configuration of Printer>

Figure 1:
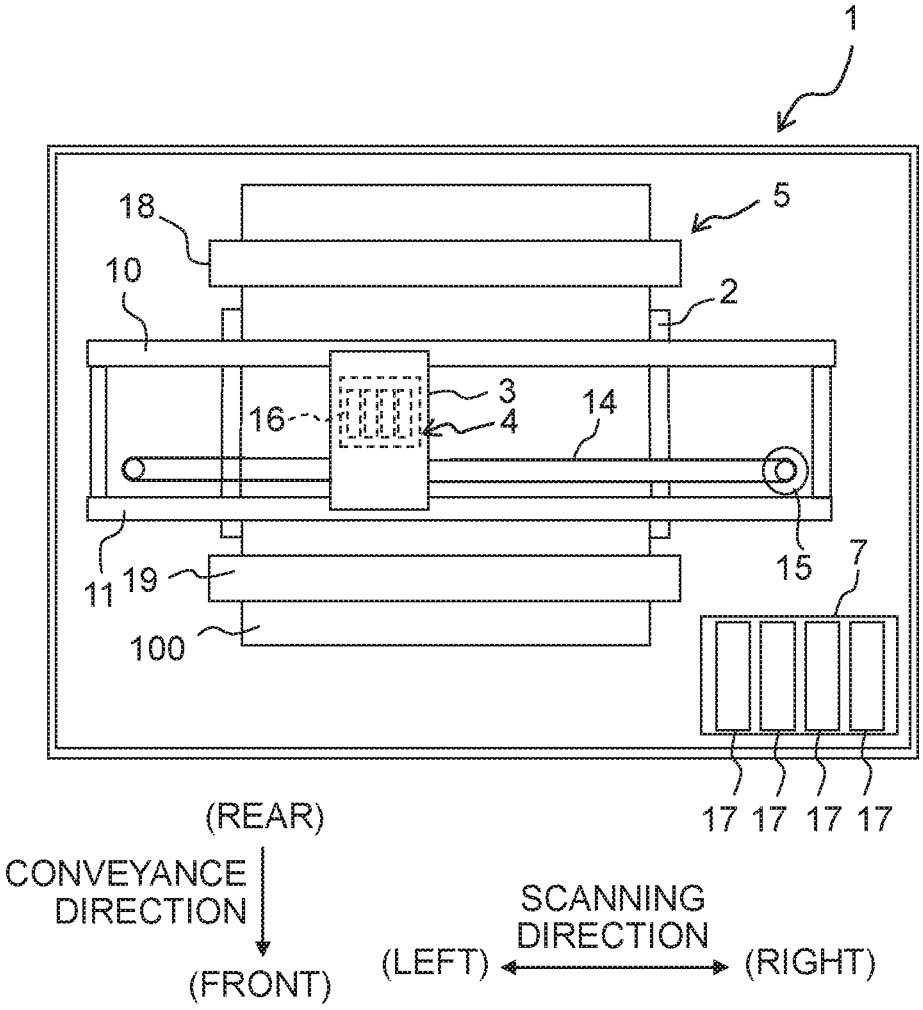
FIG. 1 is a schematic plan view of a printer 1 according to an embodiment of the present disclosure.

As depicted in FIG. 1, an ink jet printer 1 includes a platen 2, a carriage 3, an ink jet head 4, a conveyance mechanism 5, and the like. Note that hereinbelow, the respective directions of front, rear, left and right depicted in FIG. 1 are defined as "front", "rear", "left" and "right" with respect to the printer. Further, the near side of the page and the far side of the page are defined respectively as "up" and "down".

A sheet of recording paper 100 which is a recording medium is placed on the upper surface of the platen 2. The carriage 3 is configured to be movable reciprocatingly in a left/right direction (also to be referred to below as a scanning direction) along two guide rails 10 and 11 in an area facing the platen 2. The carriage 3 is linked to an endless belt 14 and, with a carriage drive motor 15 driving the endless belt 14, the carriage 3 moves in the scanning direction.

The ink jet head 4 is fitted on the carriage 3 to move in the scanning direction together with the carriage 3. The ink jet head 4 includes four head units 16 aligning in the scanning direction. Through tubes (not depicted), the four head units 16 are connected respectively with a cartridge holder 7 in which ink cartridges 17 are installed to retain inks of four colors (black, yellow, cyan, and magenta). Each of the head units 16 has a plurality of nozzles 20 (see FIGS. 2 to 4B) formed in its lower surface (the surface on the far side of the page of FIG. 1). The nozzles 20 of the respective head units 16 are to jet the inks supplied from the ink cartridges 17 toward the recording paper 100 placed on the platen 2.

The conveyance mechanism 5 has two conveyance rollers 18 and 19 arranged to interpose the platen 2 therebetween in a front/rear direction. The conveyance mechanism 5 conveys the recording paper 100 on the platen 2 in a frontward direction (also to be referred to as a conveyance direction) by means of the two conveyance rollers 18 and 19.

<Ink Jet Head>

Next, an explanation will be made about a detailed configuration of the ink jet head 4. Note that because the four head units 16 of the ink jet head 4 have the same configuration, one of head units 16 will be explained and the other will be omitted in the explanation.

As depicted in FIGS. 2 to 4B, the head unit 16 includes a channel substrate 21 (corresponding to the "substrate" of the present disclosure), a nozzle plate 23, a piezoelectric actuator 24, and a reservoir forming member 25 (corresponding to the "channel member" of the present disclosure). The head unit 16 is connected with two COFs (Chip On Film) 50. Note that in FIG. 2, for simplifying the drawing, only outlines are depicted with two-dot chain lines to represent the two COFs 50 and the reservoir forming member 25 positioned above the channel substrate 21 and the piezoelectric actuator 24.

<The Flow Channel Substrate>

The channel substrate 21 is a silicon substrate. The channel substrate 21 is formed with a plurality of pressure chambers 26. The channel substrate 21 is as thick as, for example, 100 μm. The plurality of pressure chambers 26 are arrayed in the conveyance direction to form two arrays of the pressure chambers aligning in the scanning direction. Note that in FIG. 2, for simplifying the drawing, only 18 pressure chambers are depicted to form one array of the pressure chambers. However, in reality, more pressure chambers are arrayed at a small pitch. Further, the channel substrate 21 is formed with a vibration film 30 (corresponding to the "first film" of the present disclosure) to cover the plurality of pressure chambers 26. The vibration film 30 is an insulating film of silicon dioxide ($SiO_2$), formed by oxidizing part of a surface of the channel substrate 21 which is a silicon substrate.

Further, the recesses 71 are formed in such parts of the upper surface of the vibration film 30 as overlapping in an up-down direction with inner end portions of the plurality of pressure chambers 26 along the scanning direction. The recesses 71 have a diameter D0 (46 μm or so, for example), and their depth H2 is larger than half of the thickness H1 (1.4 μm, for example) of the vibration film 30, that is, [H1/2]=0.8 μm or so, for example. Further, the edges of the recesses 71 are positioned further inward of the pressure chambers 26 than the edges of the pressure chambers 26. Further, the vibration film 30 is formed with through holes 72 (corresponding to the "first through hole" of the present disclosure) in the parts where the recesses 71 are formed. The through holes 72 have a diameter D1 (42 μm or so, for example) smaller than the diameter D0 of the recesses 71, and the edges of the through holes 72 are positioned further inward of the recesses 71 than the edges of the recesses 71. Further, with that, the edges of the through holes 72 are positioned further inward of the pressure chambers 26 than the edges of the pressure chambers 26.

<Nozzle Plate>

Figure 2:
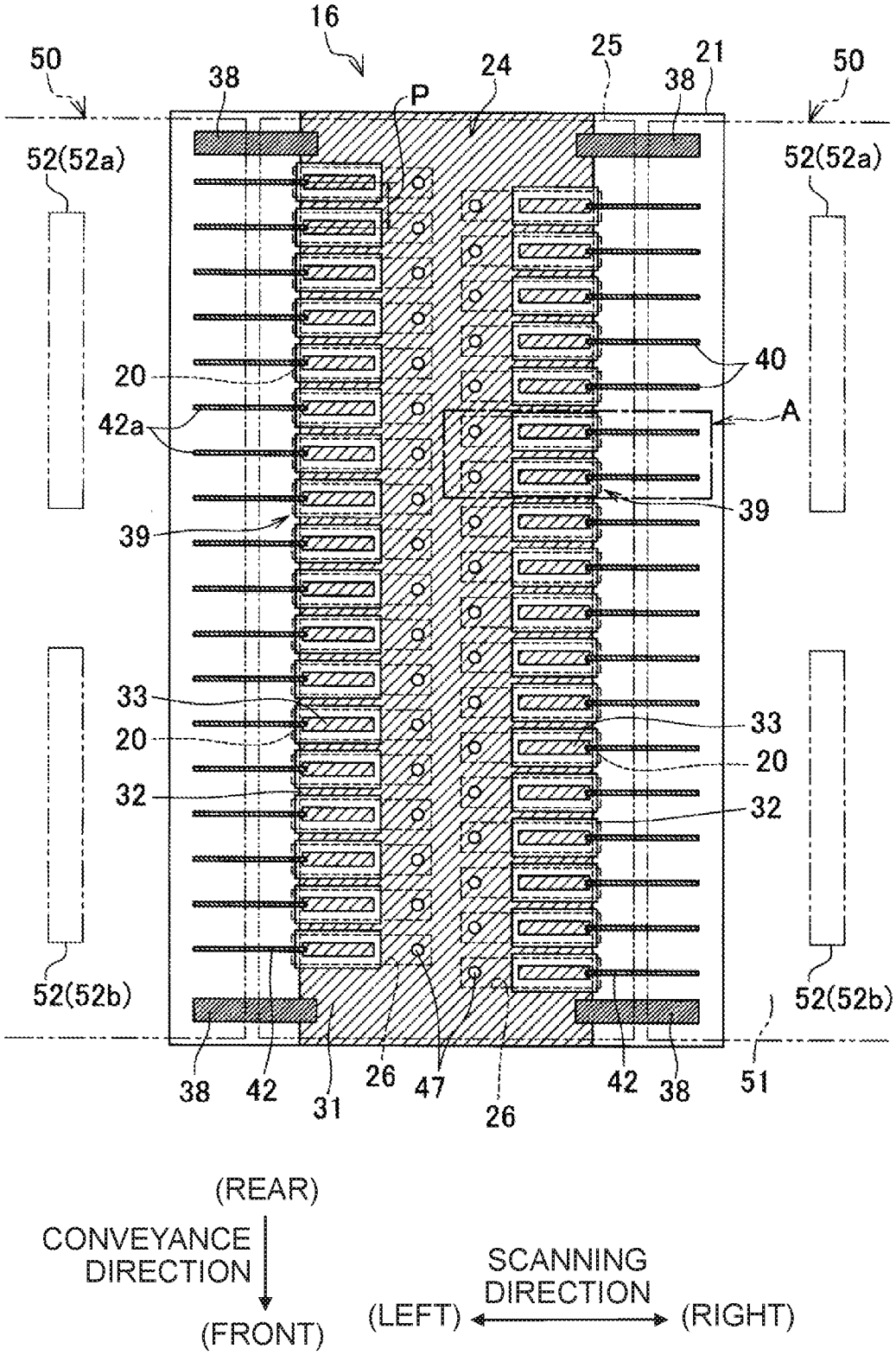
FIG. 2 is a top view of one head unit 16 of an ink jet head 4.
Figure 3:
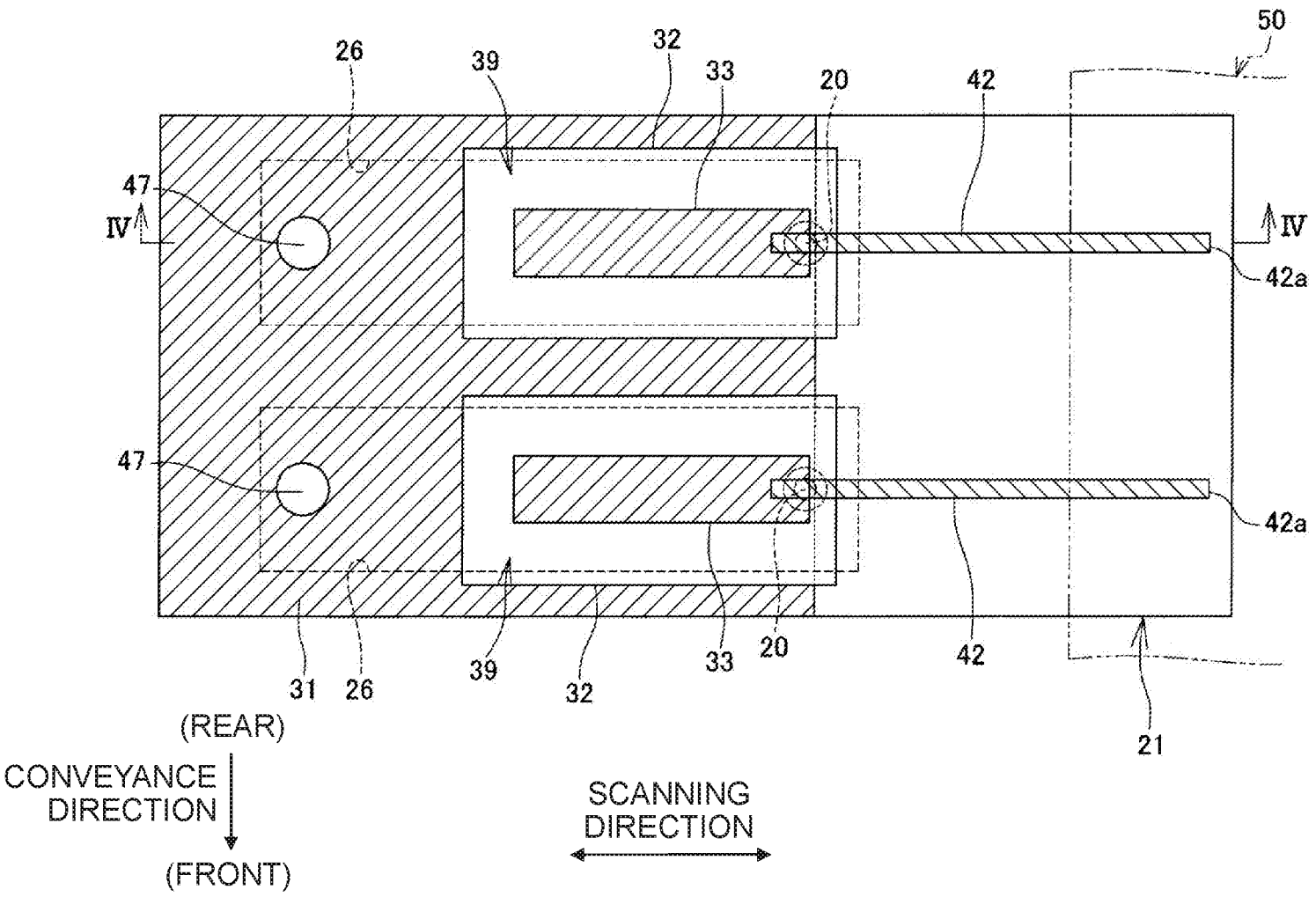
FIG. 3 is an enlarged view of part A of FIG. 2.

The nozzle plate 23 is arranged on the lower surface of the channel substrate 21. The nozzle plate 23 is formed of a synthetic resin such as polyimide or the like. The nozzle plate 23 is as thick as 30 to 50 μm. The nozzle plate 23 is formed with a plurality of nozzles 20 in respective communication with outer end portions of the plurality of pressure chambers 26 of the channel substrate 21 along the scanning direction. As depicted in FIG. 2, the plurality of nozzles 20 are arrayed in the conveyance direction just like the plurality of pressure chambers 26 of the channel substrate 21, to form two nozzle arrays aligning in the scanning direction. Between the two nozzle arrays, the nozzles 20 deviate in position along the conveyance direction by half of the arrayal pitch P, i.e. P/2, for the respective nozzle arrays.

<Piezoelectric Actuator>

The piezoelectric actuator 24 includes the vibration film 30 and a plurality of piezoelectric elements 39 arranged on the upper surface of the vibration film 30. The plurality of piezoelectric elements 39 correspond respectively to the plurality of pressure chambers 26 arrayed in two rows.

Hereinbelow, a configuration of the piezoelectric elements 39 will be explained. On the upper surface of the vibration film 30, a lower electrode 31 is formed to lie over the plurality of pressure chambers 26. The lower electrode 31 is a common electrode for the plurality of piezoelectric elements 39. The lower electrode 31 is not limited to any particular material but, for example, may be formed of platinum (Pt).

On the lower electrode 31, a plurality of piezoelectric bodies 32 are arranged to correspond respectively to the plurality of piezoelectric elements 39. The piezoelectric bodies 32 have a rectangular planar shape elongated in the scanning direction, overlapping with the corresponding pressure chambers 26 in the up-down direction. The piezoelectric bodies 32 are formed of a piezoelectric material whose primary component is, for example, lead zirconate titanate (PZT) which is a mixed crystal of lead titanate and lead zirconate. Alternatively, the piezoelectric bodies 32 may be formed of a non-lead based piezoelectric material.

An upper electrode 33 is formed on the upper surface of each piezoelectric body 32. The upper electrodes 33 are formed of, for example, platinum (Pt), iridium (Ir), or the like.

With the above configuration, one piezoelectric element 39 is formed from such a part of the lower electrode 31 as to face one pressure chamber 26, one piezoelectric body 32, and one upper electrode 33.

Figure 4A:
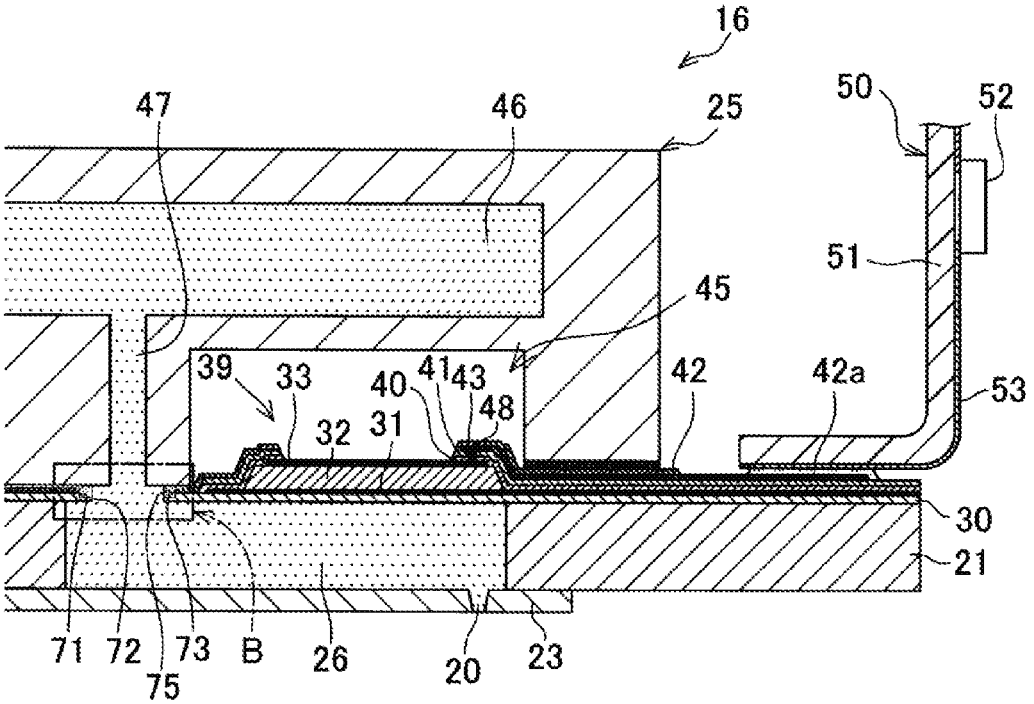
FIG. 4A is a cross-section view along the line IV-IV of FIG. 3.
Figure 4B:
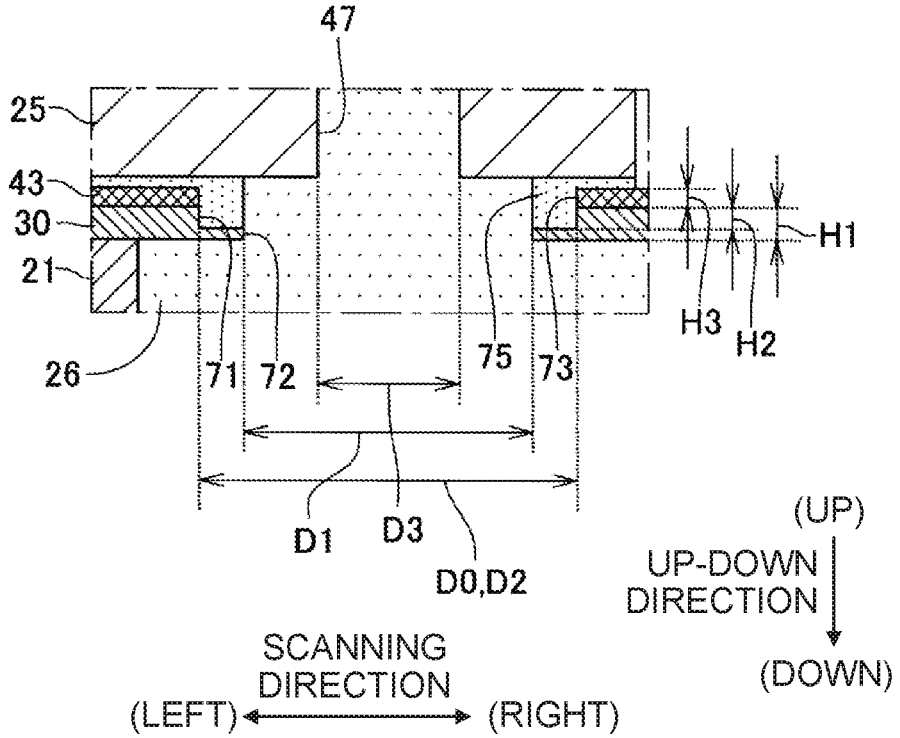
FIG. 4B is an enlarged view of part B of FIG. 4A.

As depicted in FIGS. 4A and 4B, the piezoelectric actuator 24 further includes a protection film 40, an insulating film 41, traces 42, and a trace-protection film 43 (corresponding to the "second film" of the present disclosure).

As depicted in FIG. 4A, the protection film 40 is arranged to cover the surfaces of the piezoelectric bodies 32 except for the area where central portions of the upper electrodes 33 are formed. One of the main purposes of the protection film 40 is to prevent moisture in the air from coming into the piezoelectric film 32. The protection film 40 is made of, for example, alumina ($Al_2O_3$).

The insulating film 41 is formed on the protection film 40. The insulating film 41 is not limited to any particular material but, for example, may be made of silicon dioxide ($SiO_2$). The insulating film 41 is provided for raising the insulation quality between the lower electrode 31 and the traces 42 connected to the upper electrodes 33.

On the insulating film 41, the plurality of traces 42 are formed as drawn out, respectively, from the upper electrodes 33 of the plurality of piezoelectric elements 39. The traces 42 are formed of, for example, aluminum (Al), gold (Au) or the like. As depicted in FIG. 4A, one end of each trace 42 is arranged in a position overlapping with the end of the corresponding upper electrode 33 on the piezoelectric film 32, to electrically conduct with the upper electrode 33 via a pass-through conductive portion 48 penetrating through the protection film 40 and the insulating film 41. Further, the traces 42 connected to the upper electrodes 33 arrayed on the left extend leftward from the corresponding upper electrodes 33, while the traces 42 connected to the upper electrodes 33 arrayed on the right extend rightward from the corresponding upper electrodes 33.

As depicted in FIG. 4A, the trace-protection film 43 is arranged to cover the plurality of traces 42. The trace-protection film 43 raises the insulation quality between the plurality of traces 42. Further, the trace-protection film 43 also prevents oxidation of the material (Al or the like) forming the traces 42. The trace-protection film 43 is made of, for example, silicon nitride (SiNx).

Further, the trace-protection film 43 extends up to the area surrounding the recesses 71 and through holes 72 of the vibration film 30. Note that the protection film 40 and the insulating film 41 do not extend up to the area surrounding the recesses 71 and through holes 72 of the vibration film 30. By virtue of this, such parts of the trace-protection film 43 as positioned in the area surrounding the recesses 71 and the through holes 72 are arranged on the upper surface of the vibration film 30. Further, the trace-protection film 43 is formed with through holes 73 (the "second through hole" of the present disclosure). The through holes 73 have such a diameter D2 as almost the same as the diameter D0 of the recesses 71 (46 μm or so, for example), and the edges of the through holes 73 overlap with the edges of the recesses 71 along the up-down direction. By virtue of this, the edges of the through holes 72 are positioned further inward of the through holes 73 than the edges of the through holes 73. Further, the trace-protection film 43 has such a thickness H3 (0.55 μm, for example) as smaller than the thickness H1 of the vibration film 30.

As depicted in FIGS. 2 to 4B, drive contact points 42*a*, which are the leading ends of the plurality of traces 42, are arranged at the left and right ends of the channel substrate 21 to align in the conveyance direction. As depicted in FIG. 2, the traces 42 drawn out leftward from the upper electrodes 33 are connected with the drive contact points 42*a* at the left end of the channel substrate 21, while the traces 42 drawn out rightward are connected with the drive contact points 42*a* at the right end of the channel substrate 21. Further, ground contact points 38 are also arranged at the left and right ends of the channel substrate 21 to conduct with the lower electrode 31.

<COF>

As depicted in FIGS. 2 to 4A, two COFs 50, which are wiring members, are joined respectively to the upper surface of the channel substrate 21 at the left end and at the right end. Each of the COFs 50 has a flexible substrate 51, two driver ICs 52 (a driver IC 52*a* and a driver IC 52*b*) mounted on the flexible substrate 51, and a plurality of traces 53 for connecting the driver ICs 52 and the plurality of drive contact points 42*a*, and connecting the ground contact points 38 and an undepicted control device, etc.

Based on a control signal sent in from the undepicted control device, the driver ICs 52 generate a drive signal for driving the piezoelectric actuator 24. Operation of the piezoelectric elements 39 when the drive signal is supplied from the driver ICs 52 will be explained. When the drive signal is not supplied, the upper electrodes 33 are kept at the ground potential which is the same as the lower electrode 31. From this state, if the drive signal is supplied to a certain upper electrode 33, and the drive potential is applied to the upper electrode 33, then due to the potential difference between the upper electrode 33 and the lower electrode 31, an electric field arises parallel to the thickness direction and acts on the piezoelectric body 32 between the two electrodes. On this occasion, the piezoelectric body 32 extends in the thickness direction and contracts in the planar direction due to the inverse piezoelectric effect, such that the vibration film 30 bends to project toward the pressure chamber 26. By virtue of this, the pressure chamber 26 decreases in volume to generate a pressure wave inside the pressure chamber 26, thereby discharging droplets of the ink from the nozzle 20 in communication with the pressure chamber 26.

<Reservoir Forming Member>

As depicted in FIGS. 4A and 4B, a reservoir forming member 25 is arranged at the far side from the channel substrate 21 (at the upper side) across the piezoelectric actuator 24, to be joined with the channel substrate 21 via the piezoelectric actuator 24. The reservoir forming member 25 may be, as with the channel substrate 21 for example, a silicon substrate or a member formed of a metallic material or a synthetic resin material.

A reservoir 46 is formed in the upper half part of the reservoir forming member 25 to extend in an array direction for the pressure chambers 26 (a direction perpendicular to the page of FIGS. 4A and 4B). The reservoir 46 is connected with the cartridge holder 7 (see FIG. 1) in which the ink cartridges 17 are installed, through tubes (not depicted).

In the lower half part of the reservoir forming member 25, a plurality of ink supply channels 47 are formed to extend downward from the reservoir 46. The ink supply channels 47 are in respective communication with the plurality of pressure chambers 26 of the channel substrate 21 via the through holes 72 and 73 of the piezoelectric actuator 24. By virtue of this, the inks are supplied to the plurality of pressure chambers 26 from the reservoir 46 through the plurality of ink supply channels 47. Here, the ink supply channels 47 have such a diameter D3 (38 μm or so, for example) as smaller than any of the diameter D1 of the through holes 72 and the diameter D2 of the through holes 73, and the edges of the ink supply channels 47 are positioned further inward of the through holes 72 and 73 than the edges of the through holes 72 and the edges of the through holes 73.

Further, the reservoir forming member 25 is joined to the channel substrate 21 with an adhesive 75. Here, the adhesive 75 is an insulating adhesive such as an adhesive containing epoxy resin, or the like. Further, as depicted FIGS. 4A and 4B, the adhesive 75 is also arranged in the space between the reservoir forming member 25 and the parts overlapping in the up-down direction with the through holes 73 in the upper surface of the vibration film 30. The adhesive 75 in this space renders covering of the boundary part between the vibration film 30 and the trace-protection film 43. Further, the adhesive 75 is not applied to the inner walls of the through holes 72 positioned below the recesses 71.

Further, a cover 45 is formed in the lower half part of the reservoir forming member 25. Inside the cover 45, there is a space formed to accommodate the plurality of piezoelectric elements 39 of the piezoelectric actuator 24.

<Method for Producing the Ink Jet Head>

Figure 5A:
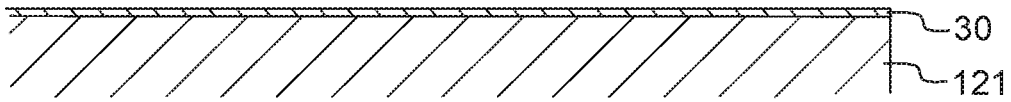
FIG. 5A is a view for explaining a process for forming a vibration film 30 on a substrate 121.

Next, a method for producing the ink jet head 4 will be explained. In order to produce or manufacture the ink jet head 4, first, as depicted in FIG. 5A, by oxidizing part of the upper surface of a substrate 121 to form the channel substrate 21, the vibration film 30 is formed on the upper surface of the substrate 121 (corresponding to the "first film forming process" of the present disclosure).

Figure 5B:
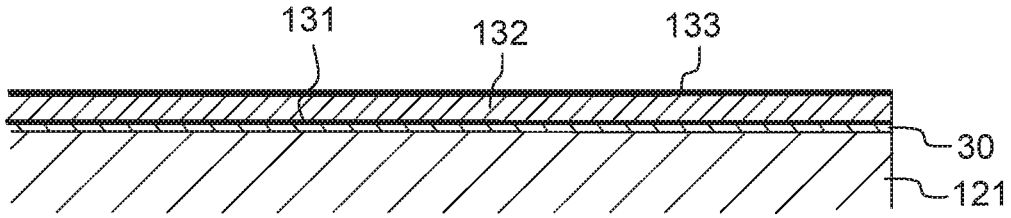
FIG. 5B is a view for explaining a process for forming electrodes 31 and 32, and films 131, 132 and 133 to constitute a piezoelectric film 32.
Figure 5C:
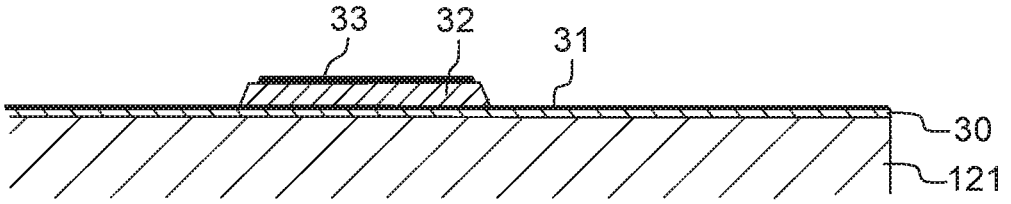
FIG. 5C is a view for explaining a process for eliminating needless parts of the films 131, 132 and 133 formed in FIG. 5B.

Then, as depicted in FIG. 5B, on the upper surface of the vibration film 30, there are formed in sequence a film 131 of platinum (Pt) to become the lower electrode 31, a film 132 of a piezoelectric material to become the piezoelectric film 32, and a film 133 of platinum (Pt), iridium (Ir) or the like to become the plurality of upper electrodes 33. Then, as depicted in FIG. 5C, by way of etching, the piezoelectric film 32 and the plurality of upper electrodes 33 are formed by eliminating needless parts of the film 133 and the film 132. Further, by way of etching, the lower electrode 31 is formed by eliminating needless parts of the film 131.

Figure 5D:
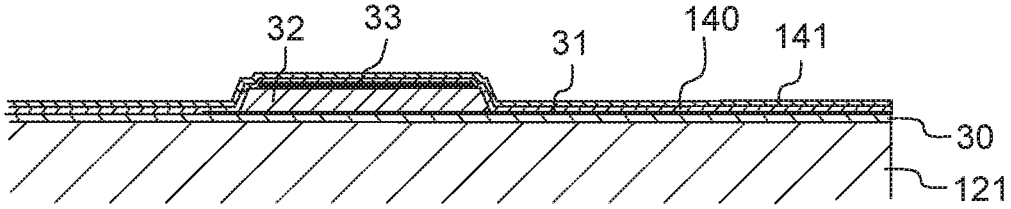
FIG. 5D is a view for explaining a process for forming a protection film 40, and films 140 and 141 to constitute an insulating film 41.
Figure 5E:
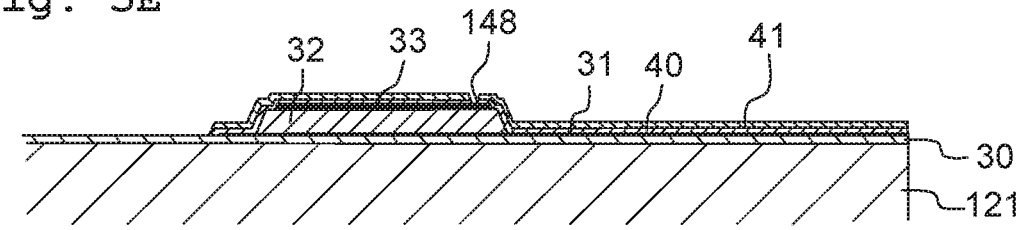
FIG. 5E is a view for explaining a process for eliminating needless parts of the films 140 and 141 formed in FIG. 5D.

Then, as depicted in FIG. 5D, there are formed in order a film 140 of alumina ($Al_2O_3$) to become the protection film 40, and a film 141 of silicon dioxide ($SiO_2$) to become the insulating film 41. Then, as depicted in FIG. 5E, by way of etching to eliminate needless parts of the films 140 and 141, the protection film 40 and the insulating film 41 are formed to have a hole 148 where the pass-through conductive portion 48 is arranged.

Figure 6A:
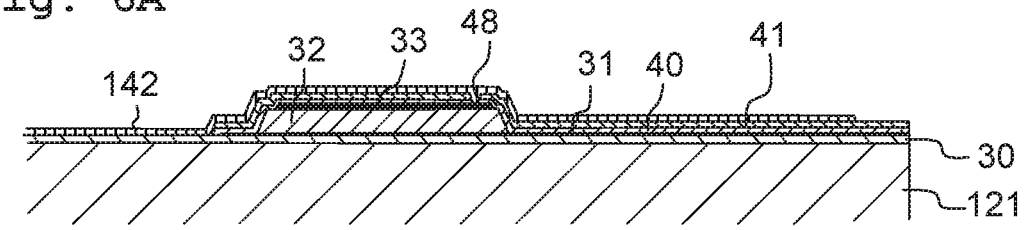
FIG. 6A is a view for explaining a process for forming a film 142 to become traces 42.
Figure 6B:
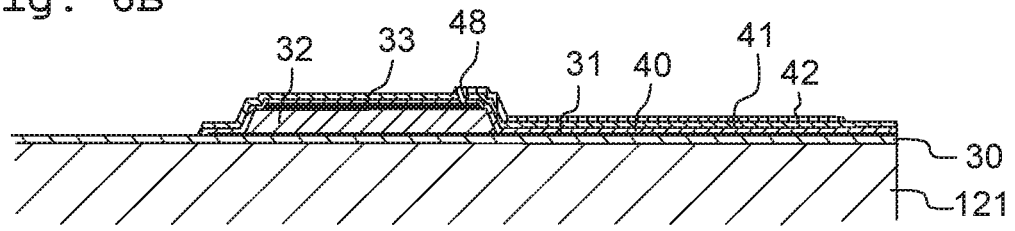
FIG. 6B is a view for explaining a process for eliminating needless parts of the film 142 formed in FIG. 6A.
Figure 6C:
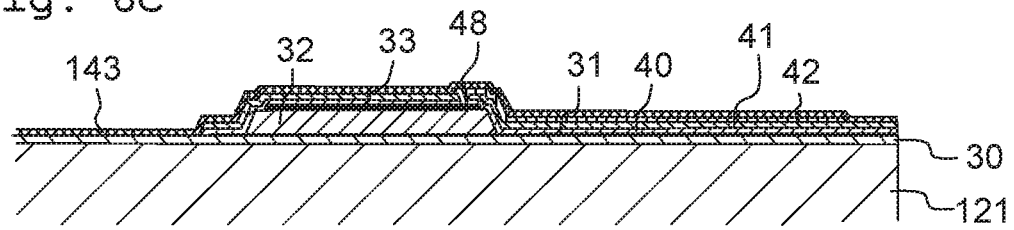
FIG. 6C is a view for explaining a process for forming a film 143 to become a trace-protection film 43.
Figure 6D:
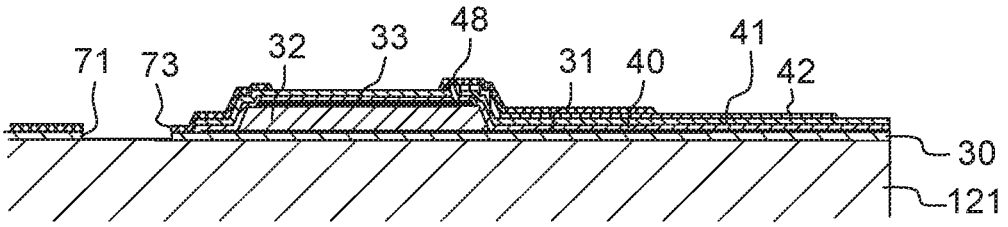
FIG. 6D is a view for explaining a process for eliminating needless parts of the film 143 formed in FIG. 6C to form through holes 73.

Then, as depicted in FIG. 6A, a film 142 is formed of aluminum (Al), gold (Au), or the like to become the plurality of traces 42. Then, as depicted in FIG. 6B, by way of etching to eliminate needless parts of the film 142, the plurality of traces 42 are formed to have the pass-through conductive portion 48. Then, as depicted in FIG. 6C, a film 143 is formed of silicon nitride (SiNx) to become the trace-protection film 43 (the "second film formation process" of the present disclosure). Then, as depicted in FIG. 6D, by way of etching to eliminate needless parts of the film 143, the trace-protection film 43 is formed to have the through holes 73 (corresponding to the "second through hole formation process" of the present disclosure). Further, on this occasion, by way of etching, the recesses 71 are formed on the upper surface of the vibration film 30.

Figure 6E:
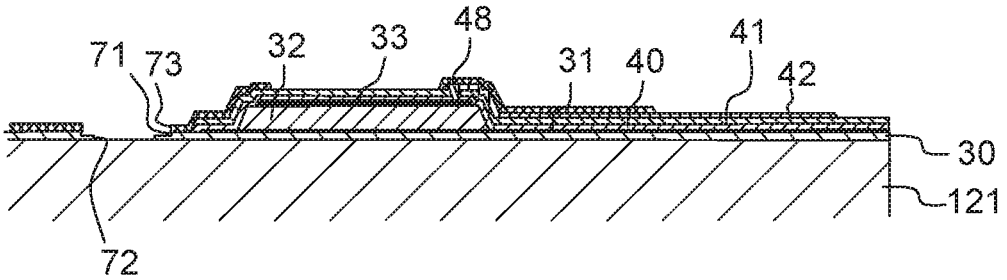
FIG. 6E is a view for explaining a process for forming recesses 71 and through holes 72.
Figure 7A:
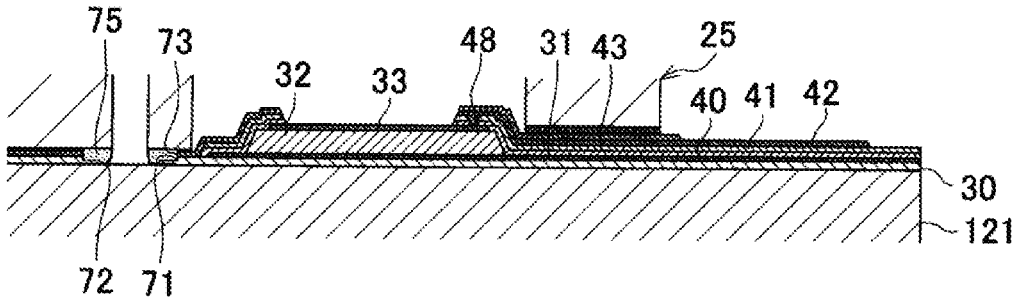
FIG. 7A is a view for explaining a process for attaching a reservoir flow channel member 25 to the substrate 121.
Figure 7B:
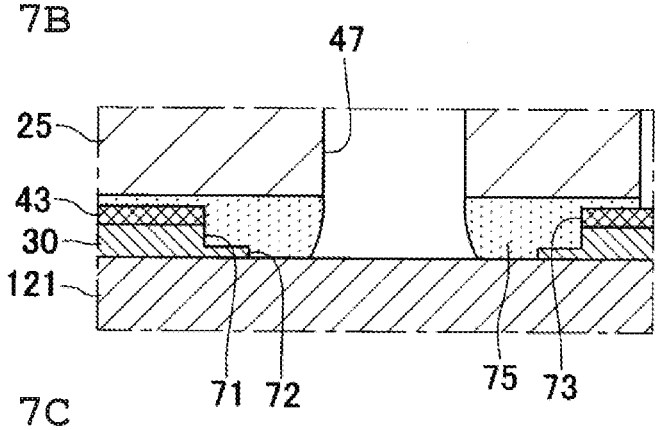
FIG. 7B is a partially enlarged view of FIG. 7A.

Then, as depicted in FIG. 6E, by way of etching, the through holes 72 are formed in the parts of the vibration film 30 where the recesses 71 are formed (corresponding to the "first through hole formation process" of the present disclosure). Then, the adhesive 75 is applied to the lower surface of the reservoir forming member 25 to join the substrate 121 and the reservoir forming member 25 with the adhesive 75 as depicted in FIG. 7A. On this occasion, as depicted in FIG. 7B, with the adhesive 75 flowing out of the junction surface between the substrate 121 and the reservoir forming member 25, the boundary part between the vibration film 30 and the trace-protection film 43 is covered. Note that at this point, the outflow adhesive 75 is also arranged on such parts of the upper surface of the vibration film 30 as to overlap with the through holes 72 along the up-down direction, in addition to the parts overlapping with the through holes 73 along the up-down direction.

Figure 7C:
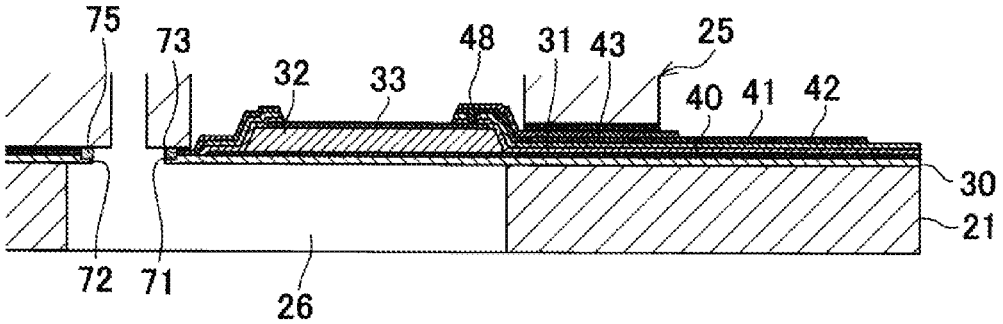
FIG. 7C is a view for explaining a process for forming pressure chambers 26.
Figure 7D:
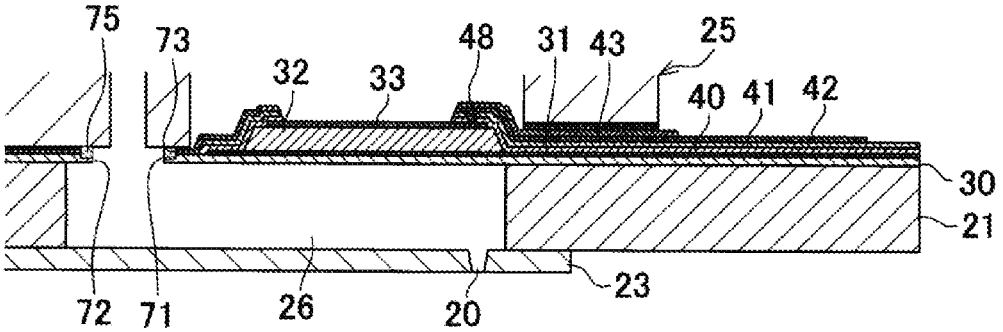
FIG. 7D is a view for explaining a process for joining a nozzle plate 23.

Then, as depicted in FIG. 7C, by a process of grinding the lower surface of the substrate 121, the substrate 121 is made as thick as the channel substrate 21 and, by way of etching, the plurality of pressure chambers 26 are formed in the substrate 121, so as to make up the channel substrate 21 (corresponding to the "pressure chamber formation process" of the present disclosure). On this occasion, such parts of the adhesive 75 flowing out when attaching the substrate 121 and the reservoir forming member 25 are eliminated as overlapping with the through holes 72 along the up-down direction. Then, as depicted in FIG. 7D, with the nozzle plate 23 prepared beforehand having been joined to the lower surface of the channel substrate 21 formed with the plurality of pressure chambers 26, the ink jet head 4 is completed.

Effects of the Embodiment

In the embodiment explained above, the edges of the through holes 72 are positioned further inward of the through holes 73 than the edges of the through holes 73, and the adhesive 75 is applied to the parts of the upper surface of the vibration film 30 overlapping with the through holes 73 (the surface at the far side from the channel substrate 21). Then, the adhesive 75 renders covering of the boundary part between the vibration film 30 of silicon dioxide ($SiO_2$) and the trace-protection film 43 of silicon nitride (SiNx). By virtue of this, it is possible to prevent the inks form penetrating between the vibration film 30 and the trace-protection film 43.

Further, in this embodiment, the through holes 73 are formed in the trace-protection film 43, then the recesses 71 and the through holes 72 are formed in the vibration film 30, then the substrate 121 is joined with the reservoir forming member 25 by the adhesive 75, and finally the plurality of pressure chambers 26 are formed in the substrate 121 by way of etching. On this occasion, such parts of the adhesive 75 are eliminated through etching as overlapping with the through holes 72 along the up-down direction. At the same time, in this embodiment, as described earlier on, the edges of the through holes 72 are positioned further inward of the through holes 73 than the edges of the through holes 73. Therefore, such parts of the adhesive 75 are not eliminated but remain as covering the junction portion between the vibration film 30 and the trace-protection film 43. In this manner, in this embodiment, with the above positional relation between the edges of the through holes 72 and the edges of the through holes 73, it is possible to form a structure of placing the adhesive 75 to cover the boundary part between the vibration film 30 and the trace-protection film 43 by only attaching the reservoir forming member 25 to the channel substrate 21 across the vibration film 30 and the trace-protection film 43. Therefore, no other members are needed for covering the boundary part between the vibration film 30 and the trace-protection film 43, and neither will the process for manufacturing the liquid discharge head become a complicated one.

Further, in this embodiment, the recesses 71 are formed in the upper surface of the vibration film 30, and the edges of the through holes 72 are positioned further inward of the through holes 73 than the edges of the through holes 73. By virtue of this, compared to a case where the recesses 71 are not formed in the vibration film 30, more quantity of the adhesive 75 will be applied on the upper surface of the vibration film 30 such that it is possible to increase the effect of preventing the liquid from penetrating between the vibration film 30 and the trace-protection film 43.

Further, in this embodiment, the depth H2 of the recesses 71 is larger than [H1/2] half of the thickness H1 of the vibration film 30. By virtue of this, by deepening the recesses 71, it is possible to increase the quantity of the adhesive applied on the upper surface of the vibration film 30.

Further, in this embodiment, because the thickness H1 of the vibration film 30 formed with the recesses 71 is larger than the thickness H3 of the trace-protection film 43, with the recesses 71 being formed in the vibration film 30, there is a high effect for increasing the quantity of the adhesive applied on the upper surface of the vibration film 30.

Further, in this embodiment, the edges of the ink supply channels 47 are positioned further inward of the through holes 72 and 73 than the edges of the through holes 72 and 73. Therefore, such a space can be formed as surrounded by the vibration film 30, the trace-protection film 43, and the reservoir forming member 25, such that it is possible to reliably leave the adhesive 75 in that space when joining the channel substrate 21 and the reservoir forming member 25.

Further, in this embodiment, because the adhesive 75 contains epoxy resin, with the adhesive 75 covering the boundary part between the vibration film 30 and the trace-protection film 43, it is possible to reliably prevent the inks from penetrating between the vibration film 30 and the trace-protection film 43.

Further, in this embodiment, the edges of the through holes 72 are positioned further inward of the pressure chambers 26 than the edges of the pressure chambers 26, and the edges of the through holes 72 are exposed to the pressure chambers 26 throughout the circumference. Therefore, as described earlier on, there is a great significance in the structure of applying the adhesive 75 to cover the boundary part between the vibration film 30 and the trace-protection film 43.

One exemplary embodiment of the present disclosure was explained above. However, the present disclosure is not limited to the above embodiment but various changes and modifications can apply thereto without departing from the true scope and spirit of the appended claims.

In the above embodiment, the diameter D3 of the ink supply channels 47 is smaller than any of the diameters D1 and D2 of the through holes 72 and 73, and the edges of the ink supply channels 47 are positioned further inward of the through holes 72 and 73 than the edges of the through holes 72 and 73. However, without being limited to that, for example, the diameter of the ink supply channels 47 may be larger than any of the diameters of the through holes 72 and 73, and the edges of the through holes 72 and 73 may be positioned further inward of the edges of the ink supply channels 47 than the edges of the ink supply channels 47. Alternatively, the diameter of the ink supply channels 47 may be almost the same as the diameter of the through holes 73, and the edges of the through holes 73 may overlap with the edges of the ink supply channels 47 along the up-down direction.

Further, in this embodiment, the thickness H1 of the vibration film 30 formed with the recesses 71 is larger than the thickness H3 of the trace-protection film 43. However, without being limited to that, the thickness of the vibration film 30 may not be larger than the thickness of the trace-protection film 43.

Further, in this embodiment, the depth H2 of the recesses 71 is larger than half of the thickness H1 of the vibration film 30 [H2>H1/2]. However, without being limited to that, the depth of the recesses 71 may not be larger than half of the thickness H1 of the vibration film 30.

Figure 8:
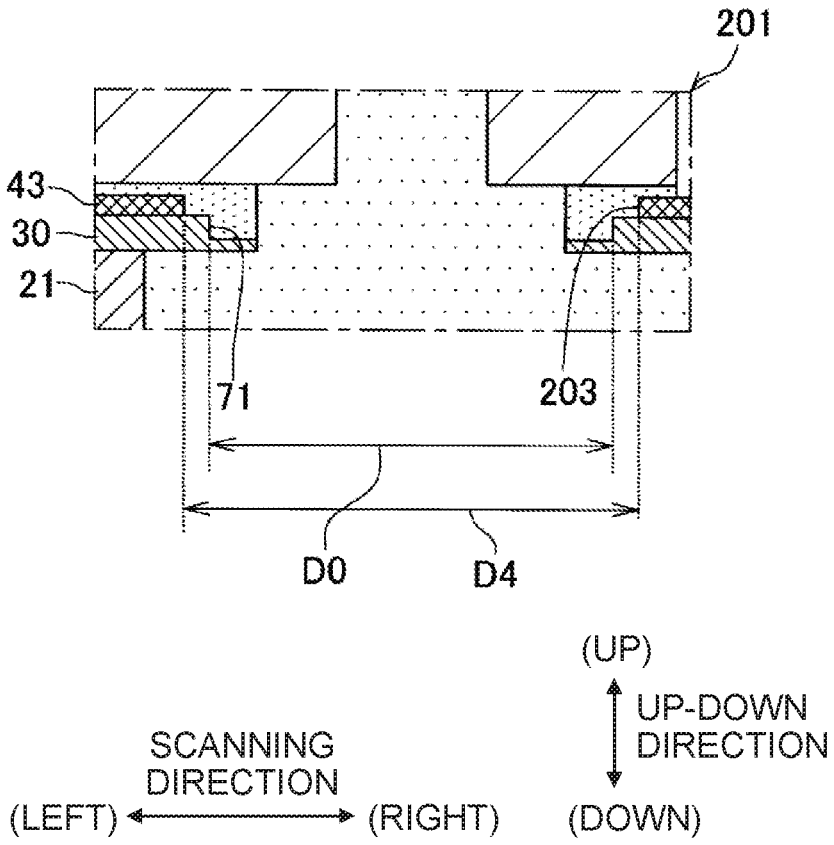
FIG. 8 is a cross-sectional view of such a connected part of a head unit 201 as between a channel substrate 21 and the reservoir flow channel member 25, according to a first modified embodiment.

Further, in this embodiment, the diameter D3 of the through holes 73 is almost the same as the diameter D0 of the recesses 71, and the edges of the recesses 71 overlap with the edges of the through holes 73 along the up-down direction. However, without being limited to that, as depicted in FIG. 8 according to a first modified embodiment, in a head unit 201, through holes 203 (corresponding to the "second through hole" of the present disclosure) formed in the trace-protection film 43 have such a diameter D4 (50 μm or so, for example) as larger than the diameter D0 (46 μm or so, for example) of the recesses 71, and the edges of the recesses 71 are positioned further inward of the through holes 203 than the edges of the through holes 203.

Figure 9:
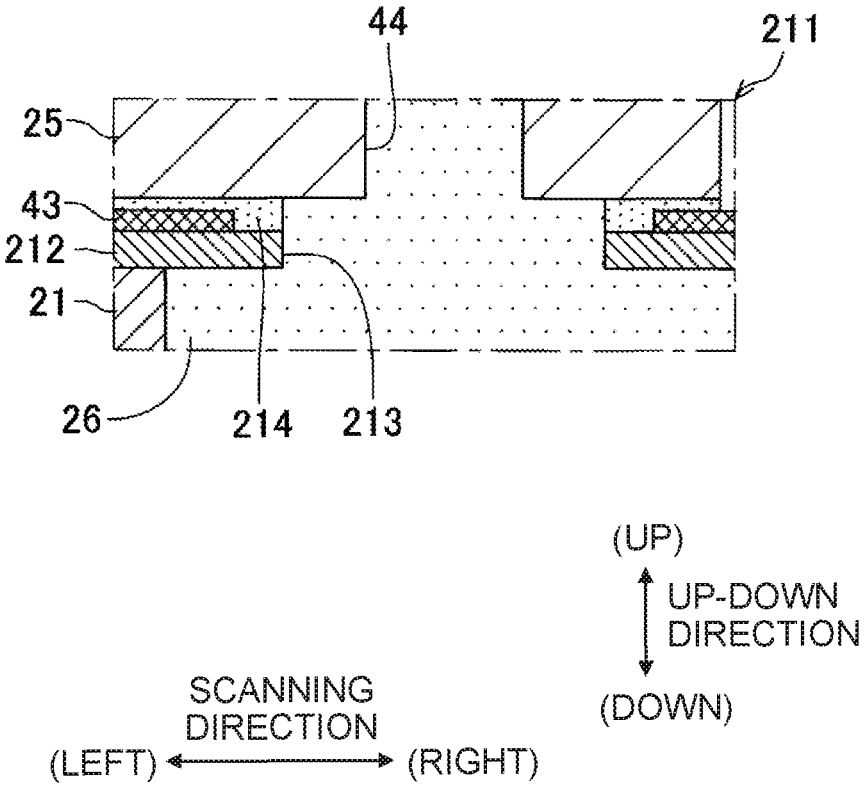
FIG. 9 is a cross-sectional view of such a connected part of a head unit 211 as between the channel substrate 21 and the reservoir flow channel member 25, according to a second modified embodiment.

Further, in the above embodiment, the recesses 71 are formed in the upper surface of the vibration film 30. However, without being limited to that, as depicted in FIG. 9 according to a second modified embodiment, in a head unit 211, no recesses are formed in the upper surface of a vibration film 212 but through holes 213 are formed, whose diameter is almost the same as the through holes 72. Then, an adhesive 214 applied to the upper surface of the vibration film 212 without any recesses covers the boundary part between the vibration film 212 and the trace-protection film 43.

Further, in the above embodiment, the trace-protection film 43 is formed of silicon nitride. However, without being limited to that, the trace-protection film may be formed of another insulating material than silicon nitride (SiNx).

Figure 10A:
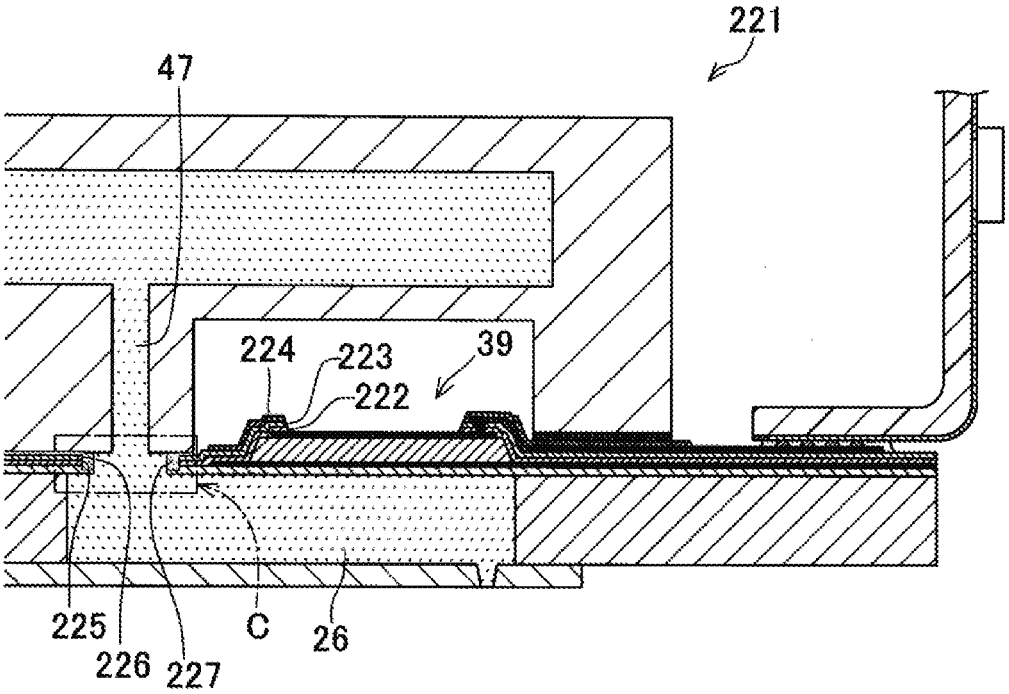
FIG. 10A is a cross-sectional view of a head unit 221 according to a third modified embodiment, corresponding to FIG. 4A.
Figure 10B:
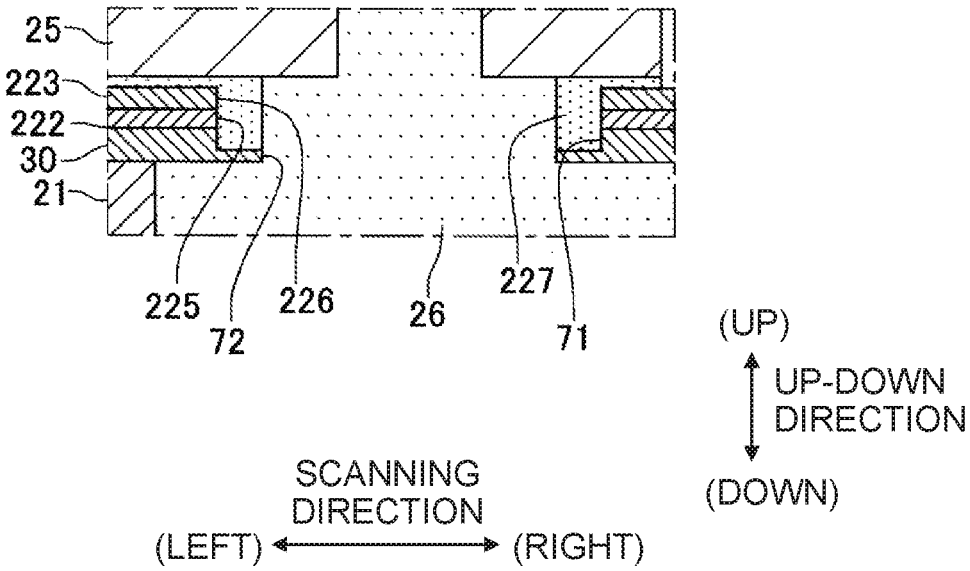
FIG. 10B is an enlarged view of part C of FIG. 10A.

Further, in the above embodiment, the trace-protection film 43 extends up to the area surrounding the recesses 71 and through holes 72 of the vibration film 30. However, without being limited to that, as depicted in FIGS. 10A and 10B according to a third modified embodiment, in a head unit 221, a projection film 222 and an insulating film 223 extend up to the area surrounding the recesses 71 and through holes 72 of the vibration film 30, but a wire projection film 224 does not extend up to the area surrounding the recesses 71 and through holes 72 of the vibration film 30. Then, overlapped through holes 225 and 226 are formed in the projection film 222 and the insulating film 223 to render communication between the pressure chambers 26 and the ink supply channels 47. Note that in the third modified embodiment, the combination of the through holes 225 and the through holes 226 correspond to the "second through hole" of the present disclosure. The diameter of the through holes 225 and 226 is almost the same as the diameter D3 of the through holes 73 (see FIG. 4B). By virtue of this, in the third modified embodiment, the edges of the through holes 225 and 226 are positioned further inward of the through holes 73 than the edges of the through holes 73, and an adhesive 227 is applied to such parts of the upper surface of the vibration film 30 as positioned between the edges of the through holes 72 and the through holes 225 and 226.

Then, in the third modified embodiment, the adhesive 227 renders covering of the boundary part between the vibration film 30, and a two-layer film (corresponding to the "element protection film" of the present disclosure) protecting piezoelectric elements 39 formed by stacking the projection film 222 and the insulating film 223. By virtue of this, it is possible to prevent the inks from penetrating between the vibration film 30 and the projection film 222, and between the projection film 222 and the insulating film 223.

Further, in the third modified embodiment, the protection film 222 is made of alumina ($Al_2O_3$), and the insulating film 223 is made of silicon dioxide ($SiO_2$). However, without being limited to that, the protection film 222 may be made of another material than alumina, for example, an oxide such as silicon oxide (SiOx), tantalum oxide (TaOx) or the like, or a nitride such as silicon nitride (SiNx) or the like. Further, the insulating film 223 may be made of another insulating material than silicon dioxide ($SiO_2$).

Further, both the trace-protection film protecting the traces 42, and the protection film and insulating film protecting the piezoelectric elements 39 may extend up to the area surrounding the recesses 71 and the through holes 72 of the vibration film 30 and, in those three films, through holes may be formed to render communication between the pressure chambers 26 and the ink supply channels 47. Note that in such a case, the combination of the through holes formed in the above three films corresponds to the "second through hole" of the present disclosure.

Further, in the above example, the film made of an insulating material extends up to the area surrounding the recesses 71 and the through holes 72 of the vibration film 30 and, in that film, the through holes are formed to render communication between the pressure chambers 26 and the ink supply channels 47. However, without being limited to that, for example, a film made of a conductive material, such as the film forming the lower electrode, may extend up to the area surrounding the recesses 71 and the through holes 72 of the vibration film 30 and, in that film, the through holes may be formed to render communication between the pressure chambers 26 and the ink supply channels 47.

Figure 11:
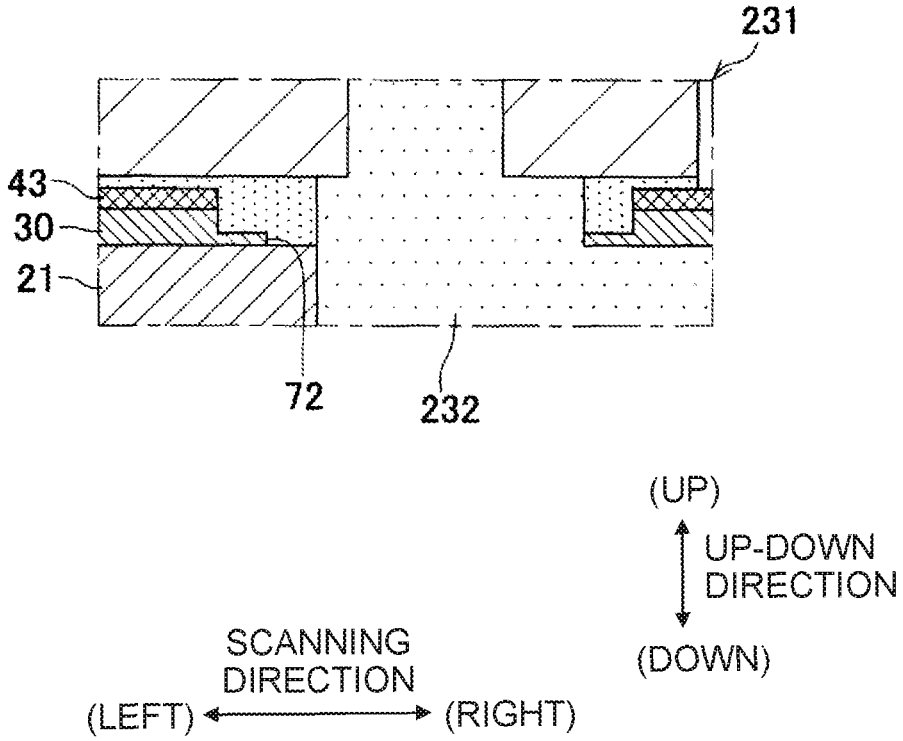
FIG. 11 is a cross-sectional view of such a connected part of a head unit 231 as between a flow channel substrate 232 and the reservoir flow channel member 25, according to a fourth modified embodiment.

Further, in the above embodiment, the edges of the through holes 72 are positioned further inward of the pressure chambers 26 than the edges of the pressure chambers 26. However, without being limited to that, for example, as depicted in FIG. 11 according to a fourth modified embodiment, in head unit 231, the inner edges of pressure chambers 232 along the scanning direction (on the left of FIG. 11) are positioned further inward of the through holes 72 than the edges of the through holes 72.

Further, in the above embodiment, the adhesive containing epoxy resin is used to join the channel substrate 21 and the reservoir forming member 25. However, without being limited to that, the adhesive for joining the channel substrate 21 and the reservoir forming member 25 may not contain epoxy resin as far as it has a sealing function against the inks.

Further, in the above embodiment, the vibration film 30 is formed of silicon dioxide. However, without being limited to that, the vibration film may be formed of a material other than the silicon dioxide such as silicon nitride or the like. For example, if the vibration film is made of silicon nitride, then it is possible to nitride part of the surface of the silicon channel substrate 21 to form the same.

Further, in the above embodiment, the channel substrate 21 is a silicon substrate. However, without being limited to that, the channel substrate 21 may be made of another material such as a metallic material or the like.

Further, in the above embodiment, the plurality of pressure chambers 26 are formed in the substrate 121 by way of etching. However, without being limited to that, the plurality of pressure chambers 26 may be formed in the substrate 121 by another method such as laser processing or the like.

Figure 12A:
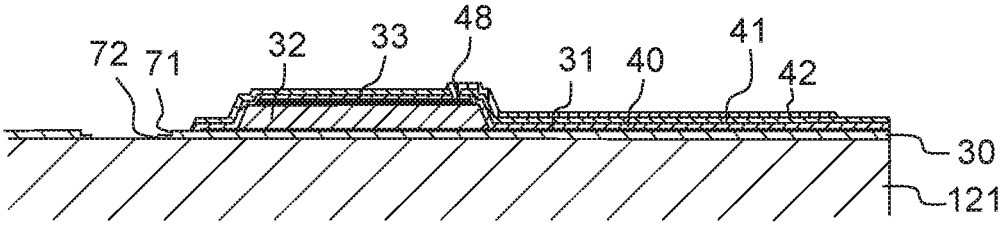
FIG. 12A is a view for explaining a process for forming the recesses 71 and the through holes 72 in the vibration film 30 according to a fifth modified embodiment.
Figure 12B:
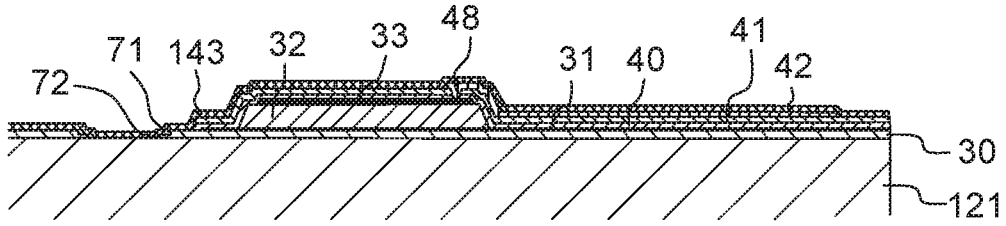
FIG. 12B is a view for explaining a process for forming the film 143 according to the fifth modified embodiment.
Figure 12C:
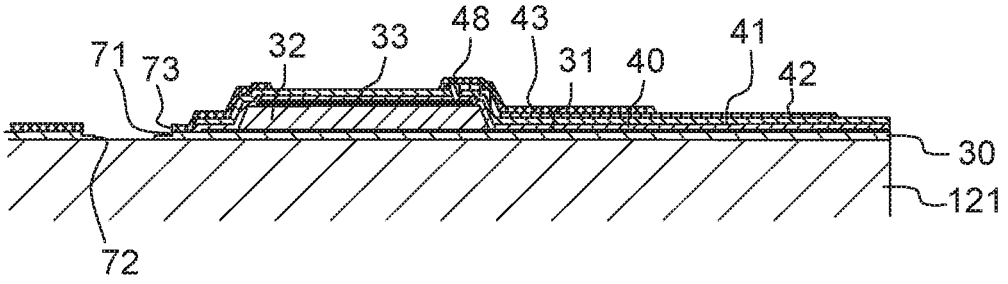
FIG. 12C is a view for explaining a process for eliminating needless parts of the film 143 according to the fifth modified embodiment.

Further, in the above embodiment, the recesses 71 and the through holes 72 are formed in the vibration film 30 after the through holes 73 are formed in the trace-protection film 43. However, without being limited to that, in a sixth modified embodiment, for example, in the same manner as in the above embodiment, after the traces 42 are formed as depicted in FIG. 6B, the recesses 71 are formed in the vibration film 30 by way of half etching as depicted in FIG. 12A and, by way of etching, the through holes 72 are formed in the vibration film 30 (corresponding to the "first through hole formation process" of the present disclosure). Then, as depicted in FIG. 12B, a film 143 is formed to become the trace-protection film 43 (corresponding to the "second film formation process" of the present disclosure). Then, as depicted in FIG. 12C, by eliminating needless parts of the film 143, the trace-protection film 43 is formed to have the through holes 73 (corresponding to the "second through hole formation process" of the present disclosure). Then, in the same manner as in the above embodiment, the ink discharge head is thereafter manufactured through the procedure depicted in FIGS. 7A to 7D.

Further, in the fifth modified embodiment, the recesses 71 and the through holes 72 are formed in the vibration film 30 immediately before the trace-protection film 43 and the film 143 are formed. However, the recesses 71 and the through holes 72 may be formed in the vibration film 30 at an earlier stage than that.

Further, such examples are taken in the above explanation that the present disclosure is applied to a printer carrying out printing by discharging ink from nozzles. However, without being limited to those examples, for example, it is also possible to apply the present disclosure to liquid discharge apparatuses which discharges other liquids than ink such as a material used for producing wiring patterns on wiring substrates, etc.

What is claimed is:

1. A liquid discharge head comprising:

a substrate including a pressure chamber;

an actuator including a driving element configured to apply pressure to liquid in the pressure chamber; and a channel member including a supply channel configured to supply the liquid to the pressure chamber, wherein the actuator includes:

a first film arranged on the substrate to cover the pressure chamber; and a second film arranged on an opposite surface of the first film in a stacking direction, the opposite surface being opposite to the substrate, wherein the channel member does not overlap the second film in an orthogonal direction orthogonal to the stacking direction, wherein the substrate and the channel member are attached to each other with an adhesive in a state that the first film and the second film are sandwiched between the substrate and the channel member, wherein a first through hole is located in a part of the first film at which the pressure chamber and the supply channel are overlapped in a stacking direction of the first film and the second film, wherein a second through hole is located in a part of the second film at which the first through hole is overlapped in the stacking direction, wherein an edge of the first through hole is positioned further inward of the second through hole than an edge of the second through hole, and wherein the adhesive is applied to a part of the opposite surface of the first film at which the second through hole is overlapped in the stacking direction, so as to cover a boundary part between the first film and the second film.

2. The liquid discharge head according to claim 1, wherein a recess is formed in a part of the opposite surface of the first film at which the pressure chamber is overlapped in the stacking direction, wherein the edge of a non-recessed portion of the first film is positioned further inward, in the orthogonal direction, than an edge of the recess of the first film, and wherein the edge of the recess overlaps with the edge of the second through hole in the stacking direction or is positioned further inward of the second through hole than the edge of the second through hole.

3. The liquid discharge head according to claim 2, wherein the recess is deeper than a half of a thickness of the first film.

4. The liquid discharge head according to claim 2, wherein the first film is thicker than the second film.

5. The liquid discharge head according to claim 2, wherein the adhesive does not adhere to an inner wall surface of the first through hole.

6. The liquid discharge head according to claim 1, wherein an edge of a connecting part, of the supply channel, connecting the second through hole is positioned further inward of the first through hole and the second through hole than the edge of the first through hole.

7. The liquid discharge head according to claim 1, wherein the adhesive includes epoxy resin.

8. The liquid discharge head according to claim 1, wherein the first film is formed of silicon dioxide.

9. The liquid discharge head according to claim 1, wherein the substrate is a silicon substrate.

10. The liquid discharge head according to claim 1, wherein the second film is formed of an insulating material.

11. The liquid discharge head according to claim 10, wherein the actuator includes a trace connected with the driving element, and the second film is a trace-protection film covering the trace.

12. The liquid discharge head according to claim 11, wherein the trace-protection film is made of silicon nitride.

13. The liquid discharge head according to claim 10, wherein the second film is an element protection film covering the driving element.

14. The liquid discharge head according to claim 13, wherein the element protection film is formed from a silicon dioxide film and an alumina film stacked on each other.

15. The liquid discharge head according to claim 1, wherein the edge of the first through hole is positioned further inward of the pressure chamber than an edge of the pressure chamber.

16. The liquid discharge head according to claim 1, wherein a portion, of the channel member, defining the supply channel is overlap the second film in the stacking direction.

* * * * *